United States Patent [19]

Webster et al.

[11] 4,310,208

[45] Jan. 12, 1982

[54] MOLDED ELECTRICAL CONNECTOR

[75] Inventors: John L. Webster, Painesville; John T. Venaleck, Mentor, both of Ohio

[73] Assignee: Chabin Corporation, Santa Clara, Calif.

[21] Appl. No.: 74,978

[22] Filed: Sep. 13, 1979

[51] Int. Cl.[3] ..... H01R 9/07

[52] U.S. Cl. ..... 339/14 R; 339/17 F; 339/97 P; 339/110 R

[58] Field of Search ..... 339/14 R, 14 L, 45 M, 339/97 R, 97 P, 99, 17 F, 176 MF, 110 R, 110 P

[56] References Cited

U.S. PATENT DOCUMENTS

| | | | |
|---|---|---|---|
| 4,030,799 | 6/1977 | Venaleck | 339/99 R |
| 4,040,705 | 8/1977 | Huber | 339/99 R |
| 4,094,564 | 6/1978 | Cacolici | 339/14 L |
| 4,105,278 | 8/1978 | Braund et al. | 339/176 MF |
| 4,130,934 | 12/1978 | Asick et al. | 339/14 R |

FOREIGN PATENT DOCUMENTS

| | | | |
|---|---|---|---|
| 2644296 | 4/1978 | Fed. Rep. of Germany | 339/97 P |

*Primary Examiner*—Neil Abrams

*Attorney, Agent, or Firm*—Maky, Renner, Otto & Boisselle

[57] ABSTRACT

A cable termination assembly according to the invention includes a cable with signal and ground isolation conductors, insulation for insulating said electrical conductors, an intermediate conductor portion of each conductor being exposed and deformed between adjacent portions of said insulation, contacts for electrically connecting respective signal conductors to an external device, the contacts being electrically connected directly to the exposed deformed intermediate conductor portions to form a junction therewith, and a body enclosing said junctions and intermediate conductor portions and securing the same in relative position while leaving part of the contacts exposed for electrically connecting with such external device. The ground conductors are in abutment for common connection thereof beyond the end of the insulation, and a secure pull tab is provided for withdrawing the assembly from a connection. The invention also relates to a method for making such assemblies.

25 Claims, 11 Drawing Figures

MOLDED ELECTRICAL CONNECTOR

TECHNICAL FIELD

The present invention generally relates to electrical connectors and to a method of making the same, and, more particularly, to cable termination assemblies especially useful in conjunction with multiconductor high speed signal transmission cables with ground signal isolation and to a method of making such assemblies.

BACKGROUND OF PRIOR ART

In the electronics field a variety of techniques have been employed to terminate electrical cables. Such cables may have one or more electrical conductors covered or separated by electrical insulation. Typically an electrical connector (cable termination) is coupled to the end of such a cable to form a cable termination assembly which facilitates connecting the one or more conductors of the cable to other cables, terminal boards, modular equipment used in computers, etc. Important features of such cable termination assemblies are facility of manufacture and/or use, mechanical strength, security and integrity of electrical connections made therein and thereby, cost efficiency, etc.

Multiconductor electrical cables have enjoyed widespread use in the electronics industry. One such multiconductor cable includes plural wires, each including a conductor covered by its own insulation, bundled together mechanically, e.g. by a fastener, external sheath, or the like. Another such multiconductor cable includes plural electrical conductors contained in and electrically isolated from each other by electrical insulation as an integral structure. Flat or ribbon cable is a particular version of this latter multiconductor cable. The insulation for such ribbon cable may be of various electrically non-conductive materials, such as plastic or plastic-like materials, polytetrafluoroethylene (e.g. Teflon), fibreglass, or like materials. Typical flat ribbon cables may have multiple conductors therein numbering more than eighty.

In some uses of ribbon cable, such as for high speed signal transmission purposes, it may be desirable electrically to isolate adjacent signal carrying conductors (hereinafter signal conductors, although some also may be connected to a reference potential, e.g. ground), for example by providing one or more conductors (hereinafter ground or isolating conductors) therebetween that are maintained at a reference potential, such as ground potential. Such electrical isolation is commonly referred to as ground isolation, it being appreciated that the reference potential may be other than ground potential, and may be achieved, for example, by connecting alternate conductors of the cable to a ground reference potential. Moreover, for high speed signal transmission purposes it has been found that woven ribbon cable and cables having Teflon or like insulation usually are most desirable.

In one prior technique for terminating a ribbon cable, the latter, a plurality of electrical contacts, and several non-conductive body parts are placed in a jig press and are secured together mechanically to form a cable termination assembly. Another technique for terminating multiconductor cables disclosed in U.S. Pat. No. 4,030,799 provides for direct penetration of electrical contacts through the cable insulation to connect with respective conductors therein and a body of dielectric material molded directly about at least part of the contacts and cable to secure the same as an integral structure. There should be adequate spacing of the conductors so that the contacts piercing the cable preferably only engage a single conductor therein.

In the past, to obtain ground isolation for such multiconductor ribbon cables the ground conductors were connected to respective contacts of the cable termination assembly, and each of these contacts were in turn connected to an external ground. Therefore, usually less than half of the remaining contacts of the cable termination assembly, i.e. those coupled to the respective signal carrying conductors, were actually available to carry useful signals. However, in U.S. Pat. No. 4,094,564 is disclosed a multiple conductor cable termination assembly in which, for example, effective ground isolation is provided the signal carrying conductors of a multiconductor cable while making efficient use of the contacts of the connector for signal connection purposes. In such assembly an electrically conductive bus electrically connects selected conductors of the multiconductor cable in common with each other and also, if desired, with one or more contacts of the connector so that all of such commonly connected conductors are at a common reference potential, such as ground potential. The majority of the contacts, then, may be used for electrical connection of signal carrying conductors for the multiconductor cable to an external device. A strain relief mechanism, which prevents force applied to the cable termination assembly tending to separate the termination from the cable from detrimentally affecting the integrity of the connections between respective conductors and contacts is disclosed in U.S. Pat. No. 4,094,564. Such mechanism is of the molded type in which the cable extends out of a strain relief body, which is molded directly about part of the cable, in a direction that is angularly displaced from the insertion and withdrawal direction of the connector contacts. Therefore, a force tending to separate the cable from the termination would be dissipated in the molded strain relief body without detrimentally affecting the connections between respective conductors and contacts, which also preferably are encased within the molded strain relief body. The angular exit of the cable from the strain relief body facilitates close packing of plural similar cable termination assemblies.

To facilitate removing electrical connectors from connection with external devices, pull tabs have been used. Such pull tabs generally permit applying a withdrawing force from a cable termination assembly without directly pulling on the cable itself.

SUMMARY OF THE INVENTION

In the present invention an electrical junction is provided in a cable termination assembly between a contact and a conductor portion which is exposed between adjacent cable insulation portions. In a multiconductor cable termination assembly, according to the invention, such exposed conductor portions preferably are deformed in a direction different than that of a major directional extent of the cable to facilitate close packing of electrical contacts and conductors while maintaining electrical isolation thereof. For a multiconductor cable termination assembly at the end of a cable, one of the two insulation portions is located entirely within the cable termination assembly, and a common connection may be conveniently provided for selected cable conductors, e.g. for ground isolation purposes, at conductor protrusions beyond such insulation portion within the assembly. Preferably a substantial portion of the cable termination assembly is molded in situ with respect to the cable thereof for security, accuracy, and maintained integrity of the components and particularly the electrical connections made therein. One or more of the commonly connected conductors also may be electrically connected at an exposed portion thereof between the two insulation portions to a contact for electrical connection to an external device; however, it will be appreciated that the common connection within the cable termination assembly frees more of the contacts for signal carrying purposes than was possible in the past while desired ground isolation is still provided.

The invention also comprehends an improved pull tab and method of including the same in a cable termination assembly to facilitate pulling the assembly from connection with an external device without straining the electrical connections between conductors and contacts in the assembly.

Briefly, the method of the present invention includes removing a length of insulation from an end of a cable to expose an end of a conductor therein, sliding a second length of insulation at least partly over the exposed conductor end leaving an intermediate portion of the conductor exposed between the second length of insulation and the major extent of the cable insulation, electrically connecting an electrically conductive member to the intermediate portion of the conductor to form a junction thereof, and enclosing the junction and the intermediate portion in a connector body while leaving part of the electrically conductive member exposed for electrically connecting the conductor with an external device. When the cable is of the multiconductor type, the second length of insulation securely holds the conductors in relatively spaced positions to facilitate manipulation thereof. Respective ones of the signal carrying conductors may be deformed in a direction different than that of the major extent of the cable to facilitate connection with respective contacts of the assembly. Upon such deformation, the ends of the signal conductors, for example, are withdrawn into the body of the second length of insulation, while leaving exposed beyond such second length of insulation the ends of the ground conductors. Such ground conductors, then, are electrically connected in common, for example by bending them into abutment with each other and applying solder to secure the connection thereof, while the second length of insulation maintains the electrical isolation of the withdrawn signal conductors from the ground conductors. The pull tab of the invention preferably has openings positioned for alignment with respective deformed parts of at least some of the signal conductors; the pull tab is placed over such signal conductors with the deformed portions of the latter protruding through such openings. Electrical contacts are placed in engagement with the respective deformed portions, and the connector body then is directly molded about portions of the contacts, conductors, cable insulation and pull tab securing the same as an integral structure.

With the foregoing in mind, it is a primary object of the present invention to provide an electrical connector, particularly a cable termination assembly, that is improved in the noted respects.

Another primary object is to provide a method of making an electrical connector, particularly a cable termination assembly, that is improved in the noted respects.

An additional object is to facilitate the making of electrical connectors, such as cable termination assemblies, particularly of the type in which plural conductors are connected in common.

A further object is to improve the mechanical and electrical integrity of cable termination assemblies, such as those employing multiconductor cable, preferably of the flat or ribbon type, especially used as transmission lines with plural common connected, e.g. to ground, signal isolating conductors.

Still another object is to provide an improved secure pull tab for a cable termination assembly.

Still an additional object is to minimize the cost for a cable termination assembly, especially of the type used in connection with multiconductor cable employed for high speed signal transmission purposes.

Still a further object is to facilitate common grounding or the like of plural conductors of a multiconductor cable terminating in a connector associated therewith.

Even another object is to facilitate close packing of the contacts of a cable termination assembly.

Even an additional object is to maximize the number of contacts and leads, as well as the close packing thereof, used for signal carrying purposes in a cable termination assembly, especially employed for high speed signal transmission purposes.

Yet another object is to facilitate the handling of plural conductors in connection with the making of a multiconductor cable termination assembly.

Yet an additional object is to expedite the making of a cable termination assembly while maintaining a high level of integrity of electrical connections made therein and thereby.

These and other objects and advantages of the invention will become more apparent as the following description proceeds.

To the accomplishment of the foregoing and related ends, the invention, then, comprises the features hereinafter fully described in the specification and particularly pointed out in the claims, the following description and the annexed drawings setting forth in detail a certain illustrative embodiment of the invention, this being indicative, however, of but one of the various ways in which the principles of the invention may be employed.

DESCRIPTION OF THE PREFERRED EMBODIMENT

Figure 1:
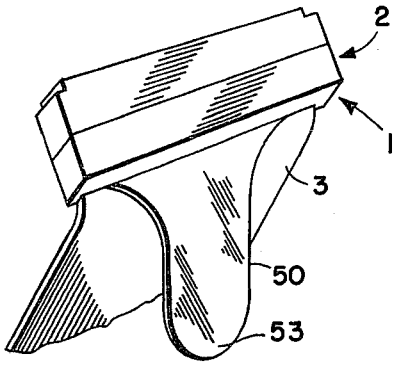
FIG. 1 is a perspective view of a cable termination assembly in accordance with the present invention.
Figure 3:
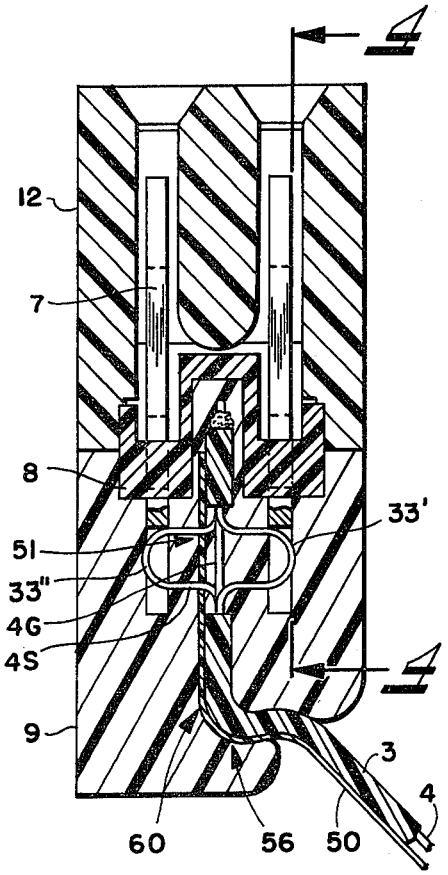
FIG. 3 is a section view of the cable termination assembly looking generally in the direction of the arrows 3—3 of FIG. 2; it is noted that the conductor loops, to be described in further detail below, are illustrated in FIG. 3 apparently in a common plane, although it will be appreciated that such conductor loops actually appear in linearly displaced parallel planes.

Referring now in detail to the drawings, wherein like reference numerals designate like parts in the several figures, and initially to FIG. 1, a cable termination assembly in accordance with the present invention is generally indicated at 1. The assembly 1 includes an electrical connector or cable termination 2 and a cable 3, which in the preferred embodiment is a multiconductor flat or ribbon type cable. Although the invention will be described below with reference to the preferred cable type, it will be appreciated that the invention may be employed in connection with other types of multiconductor cables as well as with single conductor cables. It is the purpose of the cable termination assembly 1 to connect a relatively maximum number of the conductors in the cable 3 to external devices, such as other cables, via similar, but opposite sex, connectors, terminal boards, computer modules, circuit boards, etc. It is, of course, desirable that the electrical connections made by the cable termination assembly 1 have a high level of integrity for optimum electrical signal transmission purposes.

Turning now to FIGS. 2–5, the fundamental components of the cable termination assembly 1 include the cable 3 with a plurality of conductors 4, some of which are signal carrying conductors 4S and some of which are ground isolation conductors 4G; a common connection 5 for the ground conductors; a contact carrier subassembly 6 in which a plurality of electrical contacts 7 are mounted in a molded carrier body 8; and a connector body 9 (FIG. 3) which is molded about at least part of the subassembly 6 and cable 3 securing the same in fixed relative spatial relation as an integral structure. The parts designated 3–5 may be considered a cable portion 10 of the cable termination assembly 1 and the parts 6–9 a connector portion 11 thereof. A cover 12 may be provided for the contacts 7, which in the illustrated embodiment are of the female or fork type, to guide pin-like terminals or the like of an external device into aligned engagement with respective contacts 7. To that end the cover 12, which may be reinforced or unreinforced plastic, plastic-like, epoxy, Valox, or like material having electrical insulating properties, has internal compartments 13 in which respective contacts 7 are positioned in the assembled cable termination 2 and into which are guided respective pins through openings 14 to the compartments. A stepped lower periphery 15 at the open bottom 16 is of a shape that matches a corresponding peripheral ledge 17 on the carrier body 8 to permit effective joining of the cover 12 and carrier body 8 securely by ultrasonic welding techniques, for example, as can be seen, for example, in FIG. 3. Other types of covers 12 also may be employed in the cable termination assembly 1, depending on the style, shape, etc. of the contacts 7, for example to permit connection directly to an edge of a printed circuit board or to other types of external devices relative to the assembly 1; alternatively, when the contacts 7 are of the male pin type, or the like, a separate cover 12 usually may be eliminated.

The contact carrier subassembly 6 is generally similar in configuration, function, and material to the corresponding part disclosed in U.S. Pat. No. 4,094,564, the disclosure of which is hereby incorporated by reference. The subassembly 6, however, in the present invention has the indicated peripheral ledge 17 that fits fully within the bottom 16 of the cover 12 such that the widest diameter portion of the stepped periphery 15 overlaps the rectangular outer boundary of the carrier body 8. Moreover, the carrier body 8 is molded about and in direct engagement with the contacts 7, for example in an injection molding machine, securely to hold those contacts in fixed relative positions, as shown, leaving the contact tines 18 relatively free for limited resilient movement in conventional manner as a pin contact, for example, is inserted between a pair of tines. An elongate groove or slot 20 in the carrier body 8 opens toward the bottom 21 thereof and is closed at the top 22. The groove 20 provides a confined protected area for the common connection 5 of the ground conductors 4G.

Figure 2:
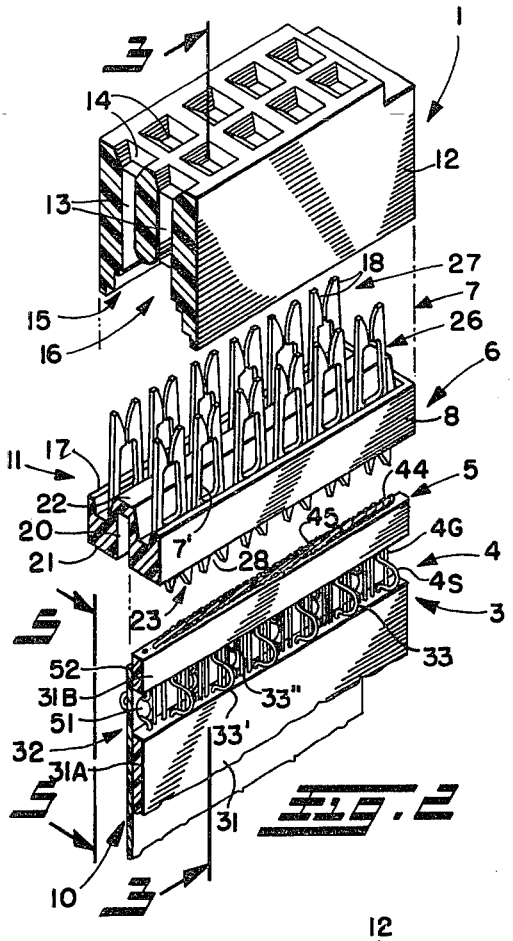
FIG. 2 is a partial exploded isometric view, partly broken away in section, of the cable termination assembly of FIG. 1.
Figure 4:
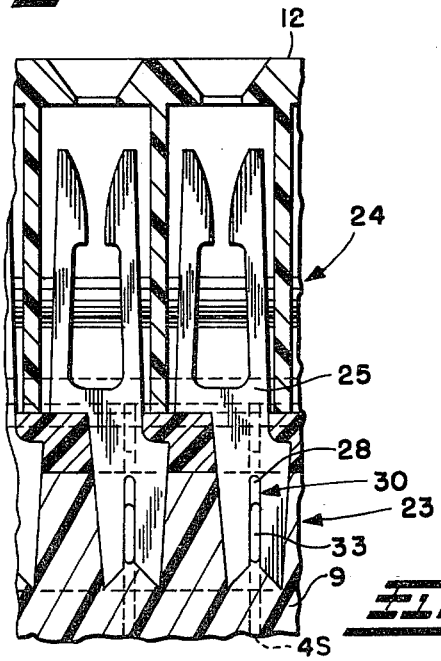
FIG. 4 is a section view of the cable termination assembly looking generally in the direction of the arrows 4—4 of FIG. 3.

Each of the contacts 7 has a junction portion 23, which is offset from the main contacting portion 24 at a contact base portion 25, as is seen most clearly in FIG. 4, for example. Such offset arrangement facilitates close packing of the contacts 7 in adjacent rows 26, 27, with the junction portions of the contacts in row 26 being offset in one direction, for example to the right as seen in FIG. 2, and those in row 27 being offset to the left, as is described in greater detail in U.S. Pat. No. 4,094,564. A slot 28 opening at the bottom of each junction portion 23 receives respective signal conductors 4S therein to form respective electrical junctions 30 therewith, as seen most clearly in FIGS. 3 and 4.

In the cable portion 10 of the cable termination assembly 1 the cable 3 is of the type preferably intended for high speed signal transmission purposes, for example, with respective signals being transmitted along the signal conductors 4S and with ground isolation being provided between adjacent signal conductors by the ground conductors 4G. The plural conductors 4 of the cable 3, which has a general directional extent downward as seen in FIG. 2, are positioned in relatively fixed spatial relation by the cable insulation 31, which may be of plastic or plastic-like, polytetrafluoroethylene (Teflon), woven, fibreglass, or like type of material providing satisfactory mechanical strength and electrical insulating properties.

Each of the conductors 4 has an exposed portion 32 between adjacent main and secondary insulation portions 31A, 31B, respectively, in the preferred embodiment the former representing the major extent of the insulation and the latter being a relatively short linear or axial section of insulation that is severed from the portion 31A and is slid along the conductors 4 to expose the portions 32 thereof. Each of the exposed portions 32S of the signal conductors 4S preferably is deformed in a direction away from the major directional extent of the cable 3; in the preferred embodiment such conductors 4S are deformed into a loop 33 which extends out of the general plane of the cable 3 by a force that tends to withdraw the ends of such conductors into the body of the insulation portion 31B. It is with these loops 33 of the signal conductors 4S that the electrical junctions 30 are formed with the junction portions 23 of respective contacts 7.

Figure 6A:
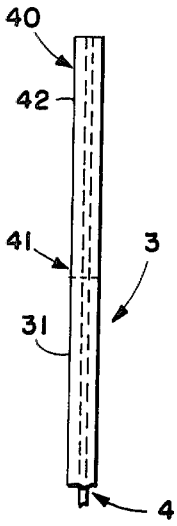
FIGS. 6A through 6E schematically illustrate respective steps in accordance with the method of the invention for making the cable portion ready for assembly in the cable termination assembly of the invention.
Figure 6B:
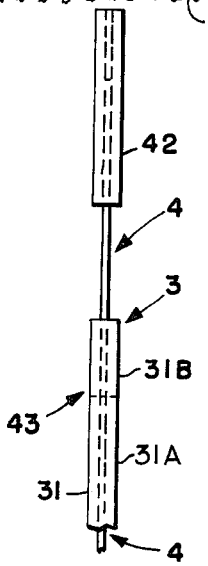

Referring now more particularly to FIGS. 6A–6E, a method of making the cable termination assembly 1, and, particularly, of forming the cable portion 10 thereof, will be described. An end elevation view of the cable 3 illustrated in FIG. 6A shows the insulation 31 extending to the very end 40 of the cable with the conductors 4 therein. Preferably the end 40 of the cable 3 is cut squarely relative to the major linear directional extent of the cable. A first cut is made at 41 through the insulation 31, but not through the conductors 4, and the end section of insulation 42 is stripped off the cable 3 leaving the conductors 4 exposed, as is seen in FIG. 6B. All or selected ones of the uninsulated ends of the conductors 4 then may be trimmed to selected lengths, if desired, although in the preferred embodiment and best mode of the invention such trimming ordinarily will be unnecessary.

Figure 6C:
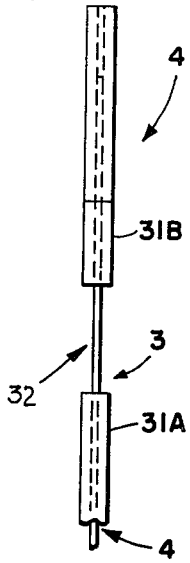
Figure 6D:
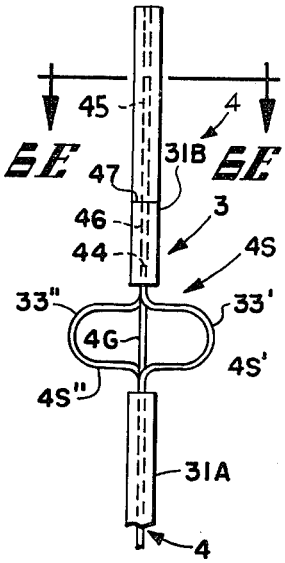
Figure 6F:
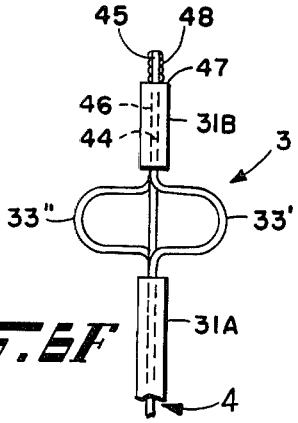
Figure 6E:
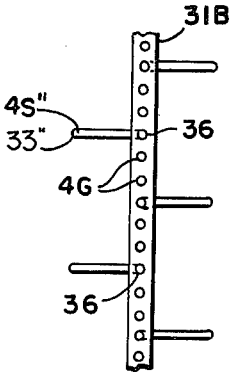

A second cut 43 is made in the insulation 31, but not through the conductors 4, to define the insulation portions 31A, 31B, and the latter portion is slid part way along the uninsulated ends of the conductors to expose the intermediate conductor portions 32 (FIG. 6C). The signal conductors 4S are deformed, either manually or by automated equipment, at their exposed portions 32 in a direction different from the major directional extent of the cable 3. Preferably alternate signal conductors are formed in loops 33 which face, respectively, in opposite directions relative to the plane of the cable 3. Thus, for example, as is seen in FIGS. 6D and 6E, the deformed portions or loops 33', 33" of alternate signal conductors 4S', 4S" face in opposite directions, which enable them to form electrical junctions with junction portions 23 of respective electrical contacts 7 in the parallel rows 26, 27 of the contact carrier subassembly 6 (FIG. 2) when the subassembly 6 and cable portion 10 are assembled. Preferably the respective loops 33', 33" of signal conductors 4S', 4S", for example, fully fit in the slots 28 of respective contacts 7', 7" (FIG. 2) so that there actually are four places at which each contact junction portion 23 engages the respective loop, i.e. on both lateral sides of each loop at both places that it passes through the contact junction portion 23, this providing a high level of integrity of electrical connection therebetween.

Moreover, as the signal conductors 4S are so deformed, the tips or ends 44 thereof are withdrawn into the insulation portion 31B a sufficient distance to maintain such conductors electrically isolated from the protruding ends 45 of the ground conductors 4G. Openings 46 from which the ends 44 of the signal conductors 4S have been withdrawn remain in the insulation portion 31B; however, such openings are small enough and long enough ordinarily to preclude foreign material from entering the same and completing an electrical connection between the protruding ends 45 of the ground conductors 4G and the end 44 of a signal conductor 4S.

While making the cable portion 10, as described, preferably the ground conductors 4G are not deformed and remain spaced apart and, therefore, electrically isolated from the signal conductors 4S in the area of the exposed portions 32 of the conductors 4 between the insulation portions 31A, 31B. If desired, though, one or more of the ground conductors 4G may be deformed in a manner similar to that of the signal conductors while preferably leaving at least a small portion 45 of such deformed ground conductor protruding beyond the insulation portion 31B for inclusion in the common connection 5. Such deformed ground conductor, though, may be electrically connected at an appropriate junction with one of the contacts 7. Similarly, it may be desired that one of the usual signal conductors 4S be a ground conductor, and in such case the deformation thereof will be minimized to assure, on the one hand, effective connection with an electrical contact 7 while the tip 44 of such conductor remains exposed beyond the insulation portion 31B for inclusion in the common connection 5.

Figure 5:
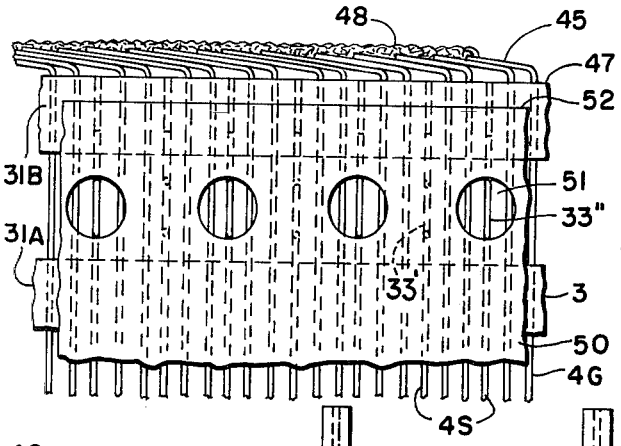
FIG. 5 is a partial plan view of the cable portion and pull tab of the cable termination assembly looking generally in the direction of the arrows 5—5 of FIG. 2.

In the preferred embodiment two ground conductors 4G are provided in the cable 3 between adjacent signal conductors 4S, as is seen most clearly in FIGS. 2, 5 and 6E. Alternatively, fewer or more of such ground conductors may be provided, as desired. To complete the cable portion 10 of the cable termination assembly 1, moreover, the protruding ends 45 of such ground conductors 4G are bent over at the edge 47 of the insulation portion 31B so that each such conductor engages the one or ones adjacent thereto, whereby all of such conductors are in effect electrically connected in common. To secure such bent over ends 45 in such position and to maintain the integrity of the common electrical connection thereof, solder 48 may be applied thereto, thus completing the common connection 5.

A pull tab 50 of plastic or plastic-like sheet material, which is used for conventional purposes, as described above, has a plurality of openings 51 (FIGS. 2 and 5) through which respective deformed portions or loops, such as the loop 33", facing in one direction away from the plane of the cable 3 protrude to hold the pull tab in place relative to the cable 3. One end 52 of the pull tab 50 preferably overlaps at least part of the insulation portion 31B, and the other end 53 (FIG. 1) extends well beyond the cable termination 2 for manual access to facilitate manually pulling the latter from connection with an external device.

To complete the process of making the cable termination assembly 1, the cover 12, if used, is placed over the carrier body 8 with the contact 7 in respective compartments 13, and the cover 12 and body 8 are ultrasonically welded or otherwise secured together. The common connection 5, at least part of the insulation portion 31B, and preferably at least part of the pull tab 50 at its end 52 are inserted into the groove 20 in the carrier body 8; during such insertion the respective exposed and deformed portions 33 of the signal carrying conductors 4S are inserted into respective slots 28 of contact junction portions 23 for electrical and mechanical connection therewith. Thereafter, the connector body 9 is molded to the remaining structure of the cable termination assembly 1, as is seen most clearly in FIG. 3. Preferably the material of which the connector body is molded at least substantially fills any voids in the connector body 9, including, for example, the remaining volume of the groove 20 not occupied by the insulation portion 31B and common connection 5, the openings 51 in the pull tab 50, the areas of the electrical junctions 30 between the signal carrying conductors and junction portions 23 of respective contacts 7, and the area of the exposed conductor portions 32 between the adjacent insulation portions 31A, 31B. Accordingly, the cable 3, conductors 4, common connection 5, contact carrier subassembly 6, electrical junctions 30, and pull tab 50 are effectively secured as an integral structure by the directly molded connector body 9.

The connector body 9 may be considered a strain relief mechanism, which is particularly cooperative with a bend 60 in the cable 3 and pull tab 50 to minimize the application of force to the electrical junctions 30 when the pull tab 50 or cable 3 is pulled in a direction tending to remove the cable termination assembly from connection with an external device, as is described, for example, in U.S. Pat. No. 4,094,564. The location 61 at which the cable 3 and pull tab 50 exit the connector body 9 have radii formed in the connector body to minimize damage to the cable, and the angle at which the cable exits the connector body facilitates close packing of such cable termination assemblies, as also is described in such patent.

STATEMENT OF INDUSTRIAL APPLICATION

In view of the foregoing, it will be appreciated that the present invention provides a facile and efficient method of making an electrical connector, which has particular utility in connection with high speed signal transmission. The electrical connector, and particularly the cable termination assembly 1 of the present invention, has a high level of mechanical and electrical integrity and provides for efficient use of components while making a relatively large number of simultaneous electrical connections.

We claim:

1. A cable termination assembly, comprising: a cable including at least plural electrical conductors and insulation means for insulating said electrical conductors, said insulation means including a main insulation portion and a secondary insulation portion separated from and spaced along said conductors from said main insulation portion to expose intermediate conductor portions of said electrical conductors between said adjacent insulation portions, each of said electrical conductors having portions in and supported by both said main and secondary insulation portions, contact means for electrically connecting at least one of said electrical conductors to an external device, said contact means including means for electrically connecting the same with said exposed intermediate conductor portion of said at least one electrical conductor to form a contained in both insulation portions for support thereby, contact means for electrically connecting at least some of said electrical conductors to an external device, said contact means including means for electrically connecting the same with respective exposed intermediate conductor portions to form respective junctions therewith, body means for enclosing said junctions and said intermediate conductor portions and securing the same in relative position while leaving part of said contact means exposed for electrically connecting with such external device, at least a plurality of said electrical conductors extending through said secondary insulation portion and having exposed ends for exposure beyond the end of said secondary insulation portion remote from said main insulation portion, and means for electrically connecting said plurality of electrical conductors in common at the exposed ends thereof.

2. The assembly of claim 1, said intermediate conductor portion comprising a loop-like portion extending away from the major directional extent of a proximate portion of said cable.

3. The assembly of claim 2, said contact means comprising engaging means for engaging said loop-like portion while extending in a direction at least approximately the same as such major directional extent.

4. The assembly of claim 3, said contact means comprising an electrical contact, and said engaging means comprising an open area in said electrical contact to engage said electrical conductor by a surface area of said electrical contact bounding such open area.

5. The assembly of claim 4, wherein said intermediate conductor portion extends at least twice through such open area to engage said surface area at four distinct portions thereof.

6. The assembly of claims 2 or 5, said body means comprising a body molded directly to at least a portion of each of said intermediate conductor portions, said contact means, and said insulation means adjacent said intermediate conductor portions fully to enclose said junction.

7. The assembly of claims 2, 3 or 4, a plurality of said electrical conductors having loop-like portions, and said contacting means comprising plural electrical contacts forming junctions with respective loop-like portions.

8. The assembly of claim 1, said means for electrically connecting in common comprising an abutting connection of multiple ones of said conductor ends.

9. The assembly of claim 8, said means for electrically connecting in common further comprising a solder connection.

10. The assembly of claim 1, said at least one of said electrical conductors comprising an end terminating within said first insulation portion electrically isolated from said at least one of said electrical conductors.

11. The assembly of claim 10, said cable comprising flat ribbon cable and said insulation means holding the major part of each of said electrical conductors in fixed relative spatial relation.

12. A cable termination assembly comprising: a cable including plural electrical conductors and insulation means for insulating said electrical conductors, said insulation means including a main insulation portion and a secondary insulation portion separated from and spaced along said conductors from said main insulation portion to expose an intermediate conductor portion of each of said electrical conductors between said adjacent insulation portions, at least a portion of each electrical conductor being contained in both insulation portions for support thereby, contact means for electrically connecting at least some of said electrical conductors to an external device, said contact means including means for electrically connecting the same with respective exposed intermediate conductor portions to form respective junctions therewith, body means for enclosing said junctions and said intermediate conductor portions and curing the same in relative position while leaving part of said contact means exposed for electrically connecting with such external device, said plural electrical conductors including plural signal conductors and plural reference conductors and common means for electrically connecting in common said reference conductors within the assembly and beyond the end of said secondary insulation portion remote from said main insulation portion while at least some of said signal conductors remain electrically isolated from said reference conductors.

13. The assembly of claim 12, said intermediate conductor portion of said signal conductors comprising a loop-like portion extending away from the major directional extent of a proximate portion of the cable, and each of said contact means including engaging means for engaging said loop-like portion while extending in a direction at least approximately the same as such major directional extent.

14. The assembly of claim 13, each of said engaging means comprising an open area in the respective contact means to engage a respective electrical conductor by a surface area of said contact means bounding such open area, said intermediate conductor portion extending at least twice through such open area tending to engage said surface area at least at four distinct portions thereof, and said body means comprising a body molded directly to at least a portion of each of said intermediate conductor portion, said contact means, and the cable insulation adjacent said intermediate conductor portion fully to enclose said junction.

15. The assembly of claim 12, said cable comprising flat cable, and said reference conductors being positioned in said flat cable to place generally in the plane of the cable a reference conductor on each side of each signal conductor.

16. The assembly of claim 13, said cable comprising flat cable having plural parallel electrical signal conductors therein, and wherein the loop-like portions of adjacent signal conductors face generally in opposite directions relative to the major planar extent of said cable.

17. The assembly of claim 16, each of said engaging means comprising an open area in said contact means to engage a respective conductor by a surface area of said contact means bounding such open area, said intermediate conductor portion extending at least twice through such open area tending to engage said surface area at least at four distinct portions thereof.

18. The assembly of claim 17, said body means comprising a body molded directly to at least a portion of each of said intermediate conductor portions, said contact means, and the cable insulation adjacent said intermediate conductor portions fully to enclose said junction.

19. The assembly of claim 16, further comprising contact carrier sub-assembly means for physically supporting said electrical contact means, said sub-assembly means including an opening for containing said common means, and said body means comprising body means molded directly to at least a portion of said contact carrier sub-assembly means.

20. The assembly of claim 15, said intermediate conductor portion of each of said signal conductors comprising a loop-like portion extending away from the major directional extent of a proximate portion of the cable and having ends terminating within said at least one of said insulation portions, said contact means including engaging means for engaging respective loop-like portions, and at least some of said reference conductors being positioned to extend substantially directly through the area between said adjacent portions of said insulation generally in the plane of the cable.

21. A cable termination assembly, comprising: a cable including plural electrical conductors and insulation means for insulating said electrical conductors, said insulation means including a main insulation portion and a secondary insulation portion separated from and spaced along said conductors from said main insulation portion to expose an intermediate conductor portion of each of said electrical conductors between said adjacent insulation portions, at least a portion of each electrical conductor being contained in both insulation portions for support thereby, wherein a group of said electrical conductors extends through and is exposed beyond said secondary insulation portion of said insulation means and common connection means for connecting the exposed ends of said group of electrical conductors, and wherein at least some of said electrical conductors terminate within said secondary insulation portion of said insulation means for electrical isolation from the commonly connected electrical conductors, contact means for electrically connecting at least some of said electrical conductors to an external device, said contact means including means for electrically connecting the same with respective exposed intermediate conductor portions to form respective junctions therewith, and body means for enclosing said junctions and said intermediate conductor portions and securing the same in relative position while leaving part of said contact means exposed for electrically connecting with such external device.

22. The assembly of claim 21, said body means comprising a body molded about all of said secondary insulation portion of said insulation means and part of said main portion of said insulation means, the latter comprising the major insulation portion of the cable.

23. A cable termination assembly, comprising: a cable including at least one electrical conductor and insulation means for insulating said electrical conductor, said electrical conductor having an intermediate conductor portion exposed between adjacent portions of said insulation, contact means for electrically connecting said electrical conductor to an external device, said contact means including means for electrically connecting the same with said exposed intermediate conductor portion to form a junction therewith, body means for enclosing said junction and said intermediate conductor portion and securing the same in relative position while leaving part of said contact means exposed for electrically connecting with such external device, said intermediate conductor portion comprising a loop-like portion extending away from the major directional extent of a proximate portion of said cable, and removal means for receiving and applying a removal force to the assembly to remove the same from connection with an external device, including electrically non-conductive sheet means having an opening through which at least part of said loop-like portion passes and an end extending in exposure outside of said body means, said body means comprising a body molded directly to at least a portion of each of said intermediate conductor portion, said contact means, the cable insulation, and said sheet means and extending into said opening to secure said removal means to said body means.

24. A cable termination assembly, comprising: a cable including at least one electrical conductor and insulation means for insulating said electrical conductor, said electrical conductor having an intermediate conductor portion exposed between adjacent portions of said insulation, contact means for electrically connecting said electrical conductor to an external device, said contact means including means for electrically connecting the same with said exposed intermediate conductor portion to form a junction therewith, and body means for enclosing said junction and said intermediate conductor portion and securing the same in relative position while leaving part of said contact means exposed for electrically connecting with such external device, said cable comprising a flat multiple conductor cable having plural parallel electrical signal conductors therein, said contact means comprising a plurality of electrical contacts electrically connected to respective ones of at least some of said electrical conductors, said intermediate conductor portion comprising a loop-like portion extending away from the major directional extent of a proximate portion of the cable, the loop-like portions of adjacent signal conductors face generally in opposite directions relative to the major planar extent of said cable, and each of said contact means including engaging means for engaging said loop-like portion while extending in a direction at least approximately the same as such major directional extent, each of said engaging means comprising an open area in said contact means to engage a respective conductor by a surface area of said contact means bounding such open area, said intermediate conductor portion extending at least twice through such open area tending to engage said surface area at least at four distinct portions thereof, and further comprising removal means for facilitating removal of the assembly from connection with an external device, including electrically non-conductive sheet means having an opening through which at least part of said loop-like portion passes and an end extending in exposure outside of said body means, said body means comprising a body molded directly to at least a portion of each of said intermediate conductor portion, said contact means, the cable insulation, and said sheet means and extending into said opening to secure said removal means to said body means.

25. A cable termination assembly, comprising: a cable including plural electrical conductors and insulation means for insulating said electrical conductors, said insulation means including a main insulation portion and a secondary insulation portion separated from and spaced along said conductors from said main insulation portion to expose an intermediate conductor portion of each of said electrical conductors between said adjacent insulation portions, at least a portion of each electrical conductor being junction therewith, at least two of said electrical conductors having conductor ends extending beyond the end of said secondary insulation portion remote from said main insulation portion, means for electrically connecting in common said conductor ends, and body means for enclosing said junction and said intermediate conductor portion and securing the same in relative position while leaving part of said contact means exposed for electrically connecting with such external device.

* * * * *